United States Patent [19]

Klomp et al.

[11] Patent Number: 4,503,817

[45] Date of Patent: Mar. 12, 1985

[54] ANNULAR VALVE STRATIFIED CHARGE SPARK IGNITION ENGINES

[75] Inventors: Edward D. Klomp, Mt. Clemens; Thomas P. Kosek, East Detroit, both of Mich.

[73] Assignee: General Motors Corporation, Detroit, Mich.

[21] Appl. No.: 349,848

[22] Filed: Feb. 18, 1982

[51] Int. Cl.[3] ..... F01L 1/28; F02P 13/00

[52] U.S. Cl. ..... 123/79 R; 123/79 C; 123/169 V; 123/151

[58] Field of Search ..... 123/79 R, 79 C, 151, 123/169 V

[56] References Cited

U.S. PATENT DOCUMENTS

| | | | |
|---|---|---|---|
| 1,323,445 | 12/1919 | Boyce | 123/79 R |
| 1,657,108 | 1/1928 | Clemens | 123/151 |
| 1,807,674 | 6/1931 | Robertson | 123/188 A |
| 2,211,013 | 8/1940 | Hosterman | 123/79 C |
| 2,222,730 | 11/1940 | Wallgren | 123/188 P |
| 2,222,731 | 11/1940 | Wallgren | 123/198 R |
| 2,756,732 | 7/1956 | Olson | 123/79 C |
| 3,180,327 | 4/1965 | Neir | 123/79 R |
| 4,106,439 | 8/1978 | Kanao | 123/432 |

*Primary Examiner*—Craig R. Feinberg
*Assistant Examiner*—Cynthia R. Carter
*Attorney, Agent, or Firm*—Robert J. Outland

[57] ABSTRACT

An internal combustion engine having an annular port and valve arranged to direct flow from dual inner and outer portions of the port in cylinder flow patterns having radially oppositely directed flow components. Various embodiments providing cylinder charge stratification or dual inlet and exhaust valve functions are disclosed.

9 Claims, 7 Drawing Figures

ANNULAR VALVE STRATIFIED CHARGE SPARK IGNITION ENGINES

TECHNICAL FIELD

This invention relates to internal combustion engines and more particularly to a novel annular valve arrangement for spark ignition engines usable in various arrangements to obtain cylinder charge stratification and/or dual inlet and exhaust functions.

BACKGROUND

Various proposals are set forth in the prior art for providing charge stratification in piston type internal combustion engines wherein the cylinder charge is stratified with a central cloud of combustible mixture located near the spark plug at the outer closed end of the cylinder. Various arrangements for dual function inlet-exhaust valves have also been proposed.

SUMMARY OF THE INVENTION

While prior art systems have provided varying degrees of charge stratification in actual use, applicants have considered that more effective and clear cut cylinder charge stratification may be obtainable through use of symmetric or substantially symmetric intake systems. For this purpose, the present invention provides an annular poppet valve mounted in the cylinder head at the closed end of and preferably coaxial with the cylinder of a piston type internal combustion spark ignition engine. The valve is arranged to provide dual inner and outer flow paths with radially directed components that may be arranged in various ways to direct a combustible cylinder charge into a central portion adjacent the end of the cylinder where the spark plug is located preferably on the cylinder axis.

Various exemplary arrangements have been conceived for applying the novel annular valve to both two and four stroke cycle engines as well as for use as a dual fluid intake valve or a dual function intake and exhaust valve. In all of the arrangements, central cloud cylinder charge stratification may be provided although other uses of the valve structure may also be contemplated within the scope of the invention.

These and other features and advantages of the invention will be more fully understood from the following description of various exemplary alternative embodiments taken together with the accompanying drawings.

BRIEF DRAWING DESCRIPTION

DETAILED DESCRIPTION

Figure 1:
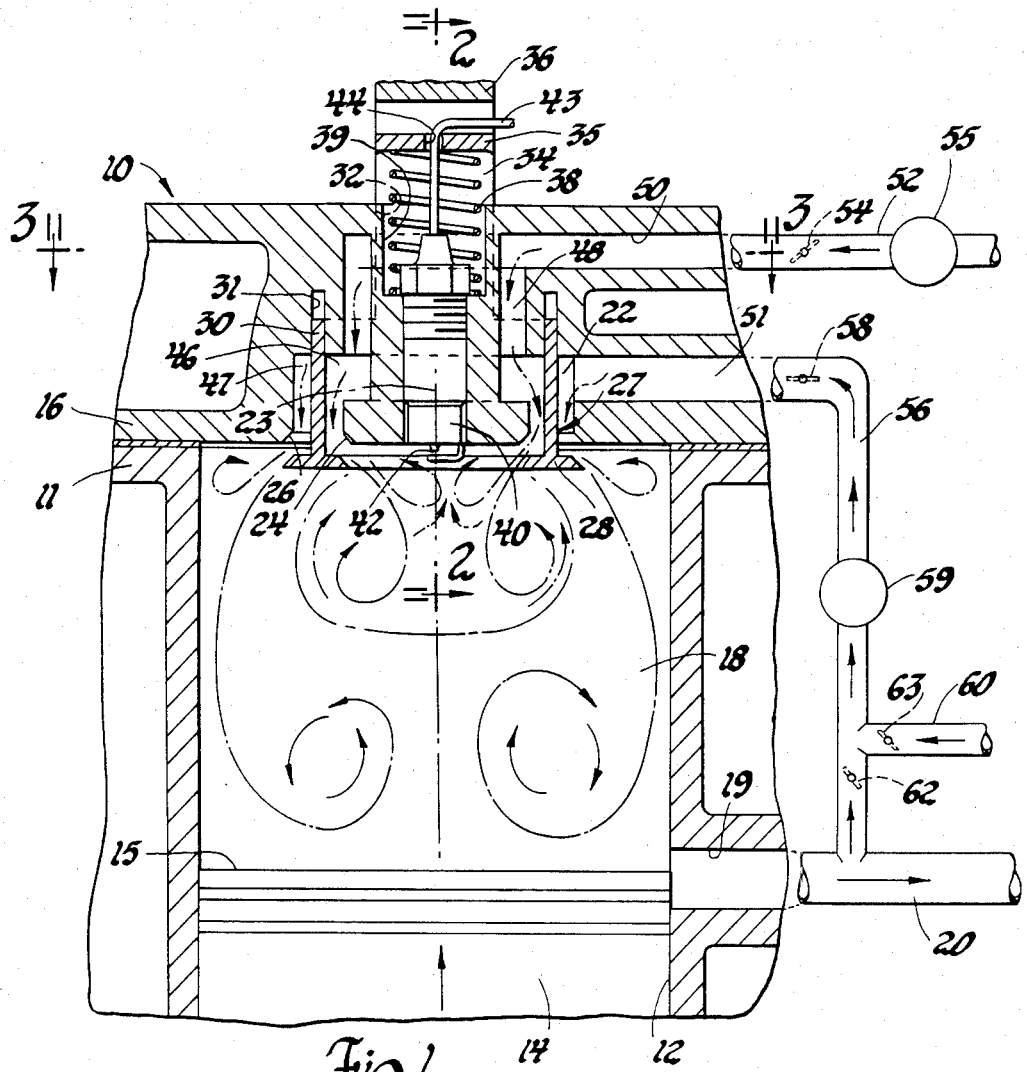
FIG. 1 is a cross-sectional view through a portion of one cylinder of a two stroke cycle spark ignition stratified charge internal combustion engine formed in accordance with the invention.
Figure 2:
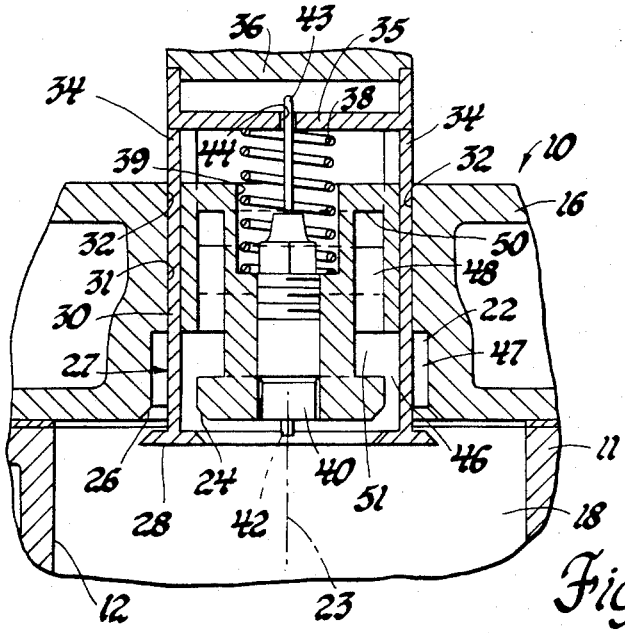
FIG. 2 is another cross-sectional view in the plane indicated by the line 2—2 of FIG. 1.
Figure 3:
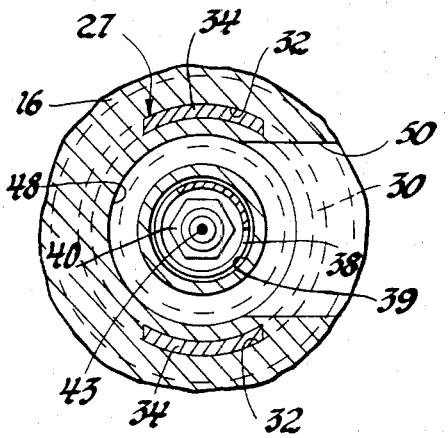
FIG. 3 is a cross-sectional view in the plane indicated by the line 3—3 of FIG. 1.

Referring first to FIGS. 1–3 of the drawings, numeral 10 generally indicates an internal combustion engine formed in accordance with the invention. Engine 10 includes a cylinder block 11 defining at least one cylinder 12 in which a piston 14 having a closed end 15 is reciprocably disposed. A cylinder head 16 is mounted on the cylinder block 11 opposite the closed end 15 of the piston to define therewith and with the cylinder 12 a variable volume working and combustion chamber 18. An exhaust port 19 extends through the block into the cylinder just above the bottom of reciprocating motion of the piston closed end. Port 19 connects externally with an exhaust conduit 20 for carrying away exhaust gases when the port is opened near the bottom of piston travel.

In accordance with the invention, the cylinder head defines an annular port 22 opening to the cylinder through its closed end in an annulus having an axis 23 coincident with the cylinder axis. Concentric annular valve seats 24, 26 are provided at the inner and outer edges of the port respectively where it opens to the cylinder at its closed end.

Carried within the cylinder head and extending through the annular port 22 is an annular valve 27. Valve 27 includes an annular head 28 that is seatable upon the valve seats 24, 26 and a tubular stem 30 that extends upwardly from the head through the annular port and into an annular groove 31 in the cylinder head. The groove 31 connects with upwardly extending oppositely spaced slotted portions 32 opening through the top of the cylinder head.

Oppositely spaced extensions 34 of portions of the annular valve stem extend upward through the slotted portions 32 above the cylinder head where they are connected by a valve bridge 35 that extends transversely between them. A cap 36 received between upwardly extending arms of the bridge is adapted to be engaged by suitable valve actuating means, not shown, for opening the valve. A spring 38 is received in a recess 39 centrally of the valve stem and extends out of the head into engagement with the bottom of the valve bridge 35 to urge the valve in a closing direction.

A spark plug 40 is mounted in the cylinder head axially of the cylinder within an opening extending through the head centrally of the valve so that the spark gap 42 is located centrally of the cylinder end and the surrounding annular port 22. The spark plug extends upward within the spring 38 and is connected with an electrical conductor 43 that extends up through an opening 44 in the valve bridge for connection with suitable ignition means not shown.

The portions of the cylinder head defining the groove 31 in which the stem 30 of the annular valve is reciprocably received function effectively as a valve guide for supporting the valve for reciprocating motion within the cylinder head. Extension of the valve stem longitudinally through the annular port 22 serves to divide the port into separate annular inner and outer portions 46, 47 respectively. The inner portion 46 is connected by an annular passage 48 with a first lateral passage 50 opening externally of the cylinder head. Outer portion 47 connects with a second lateral passage 51 which lies below passage 50 and also opens outwardly of the cylinder head.

In the instant embodiment, the valve 27 and its associated intake system are arranged to supply to the cylinder differing intake fluids through the inner and outer portions of the annular port 22. For this purpose, the first lateral passage 50 is connected with a first intake conduit 52 preferably including an adjustable control valve 54 and a charge blower 55. Conduit 52 is connected with a source, not shown, of air-fuel mixture for delivery to the central portion of the cylinder.

The second lateral passage 51 is in like manner connected with a second intake conduit 56 also preferably having a control valve 58 and a charge blower 59. Conduit 56 is preferably connected with the exhaust conduit 20 for providing recirculated exhaust gas to the second passage 51. An alternate intake conduit 60 also connected with conduit 56, provides a source of fresh air or other alternative, preferably noncombustible fluid. Control valves 62, 63 are provided to regulate the proportions of recirculated exhaust gas and fresh air or other fluid supplied through conduit 56 and passage 51 to the outer annular portion 47 and therethrough to the outer portion of the cylinder.

The engine embodiment just disclosed is operated on the two stroke cycle wherein exhaust blowdown occurs as the piston nears its bottom dead center position and begins to open the exhaust port 19. Thereafter, the annular valve 27, which serves as an intake valve, is opened while the exhaust port 19 remains open as shown in FIG. 1.

With the valve 27 in the open position, a fresh charge of air-fuel mixture is forced by blower 55 through the first intake conduit 52, and passages 50 and 48 to the annular inner portion 46 of the port 22. The annular head 28 of the valve is flared where it engages the seats 24, 26 so that it extends radially inwardly of the port inner portion 46 and radially outwardly of the port outer portion 47. Thus the air-fuel mixture entering the cylinder from the port inner portion is directed at an angle toward the cylinder axis, causing a localized body of combustible fluid to be formed near the cylinder end having dual toroidal fluid flow patterns as illustrated in FIG. 1.

At the same time, blower 59 forces recirculated exhaust gas, fresh air or a mixture of the two, as desired, into the conduit 56 and forces it through passage 51 to the outer portion 47 of the annular port 22. Here the outward bevel of the valve head outer edge, which causes it to extend radially beyond the outer extremes of the port 22, directs the recirculated exhaust or fresh air at an angle outwardly toward the cylinder periphery as it enters the cylinder. This forms a dual toroidal flow pattern of noncombustible fluid extending downwardly along the cylinder walls and along the piston head below the body of air-fuel mixture centered at the end of the cylinder.

Subsequently, during compression of the cylinder charge on the upward stroke of the piston, the relative positions of the stratified charge elements remain constant, with the combustible mixture being compressed in the center upper end of the chamber around the spark plug for ignition shortly before the piston reaches its top dead center position. The burning time is short due to the compact positioning of the mixture about the spark plug. Further, if mixing of the air-fuel mixture with the surrounding noncombustible fluids is not excessive, the combustible mixture is separated from the combustion chamber walls by the noncombustible fluids. Thus, combustion may be relatively complete with very little wall quenching effect.

The power level of the engine may be controlled by adjusting the openings of the control valves 54, 58 to vary the amount of air-fuel mixture delivered to the combustion chamber inversely with the amount of noncombustible mixture delivered. For full power, the noncombustible mixture may be cut off completely by closing valve 58, allowing a full charge of combustible mixture to be delivered to the cylinder through the wide open valve 54.

In order to maintain more completely the separation between the stratified charges of air-fuel mixture and noncombustible fluid delivered to the cylinder, it may be desirable to provide for the development of swirl in the inlet charges. This may be accomplished by, for example, providing angled vanes on the inner and outer faces of the tubular valve stem or within the port walls near the lower ends of the port inner and outer portions 46, 47 respectively. Other modifications could also be employed. For example, the valve head could be seated flat against valve seats formed by the lower face of the cylinder head instead of providing beveled valve seats as shown in FIG. 1. In this way, more extreme radial components of flow into the cylinder could be provided.

Figure 4:
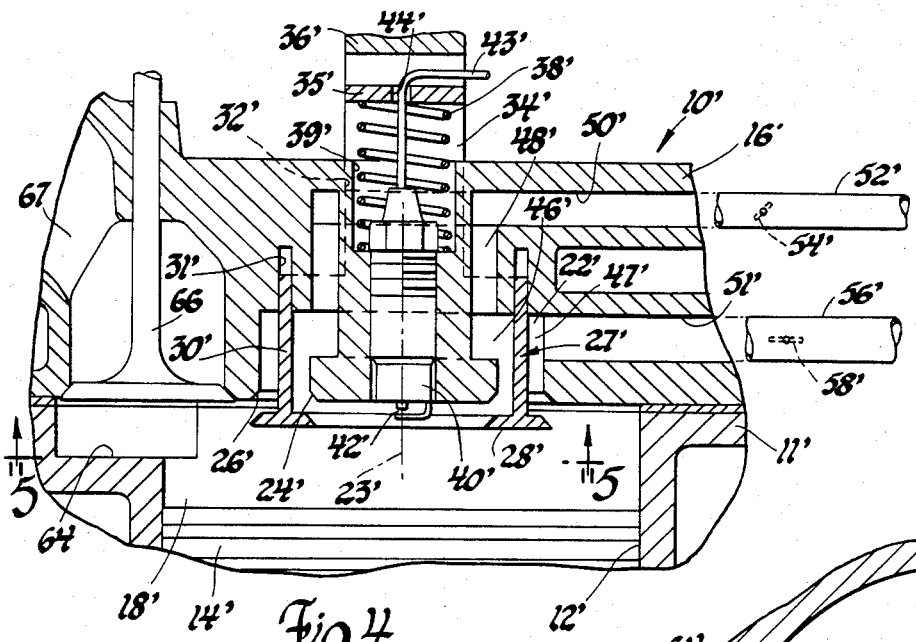
FIG. 4 is a cross-sectional view similar to FIG. 1 but showing an embodiment of a four stroke cycle stratified charge engine having annular valve means in accordance with the invention.
Figure 5:
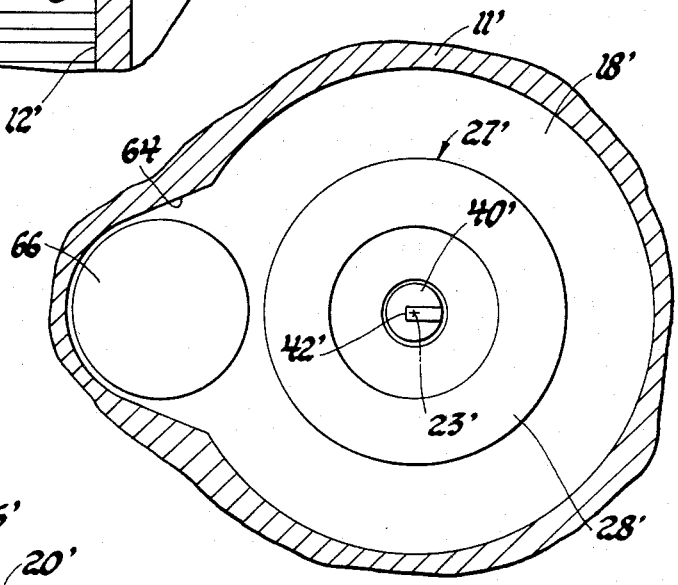
FIG. 5 is a cross-sectional view in the plane indicated by the line 5—5 of FIG. 4.

Referring now to FIGS. 4 and 5 of the drawings, there is shown an alternative embodiment of internal combustion engine according to the invention. In this embodiment, the engine is intended for operation on the four stroke cycle; however, since many of the elements are identical with elements of the first described embodiment, primed reference numerals of like value will be used for like parts.

The construction of the embodiment of FIGS. 4 and 5 differs from that of FIGS. 1–3 in elimination of the cylinder exhaust port 19 and the charging blowers 55 and 59 which are required for two cycle operation. The construction adds an exhaust chamber 64 located to one side of each cylinder to provide a pocket for receiving the head of an associated exhaust valve 66 mounted in the cylinder head. Valve 66 controls a separate exhaust port 67 extending through the cylinder head in conventional fashion. In other ways, the construction of the embodiment of FIGS. 4 and 5 is essentially like that of FIGS. 1–3.

In operation, the annular inlet valve 27' is opened on the downward intake stroke of the piston 14'. Valves 54' and 58' in the intake conduits 52', 56' respectively, are adjusted to control the relative amount of fluid admitted to the cylinder from the inner and outer annular portions 46', 47' respectively of the annular port 22'. By admission of a combustible air-fuel mixture through the port inner portion and a noncombustible fluid through the port outer portion, a stratified charge of gases is developed in the cylinder in the same fashion as described with respect to the embodiment of FIGS. 1–3, and upon subsequent compression, the combustible mixture surrounding the spark gap 42' is ignited and burns. After expansion, the exhaust valve 66 is opened allowing the cylinder to be cleared of exhaust gases on the upward exhaust stroke of the piston and the cylce is repeated.

Figure 6:
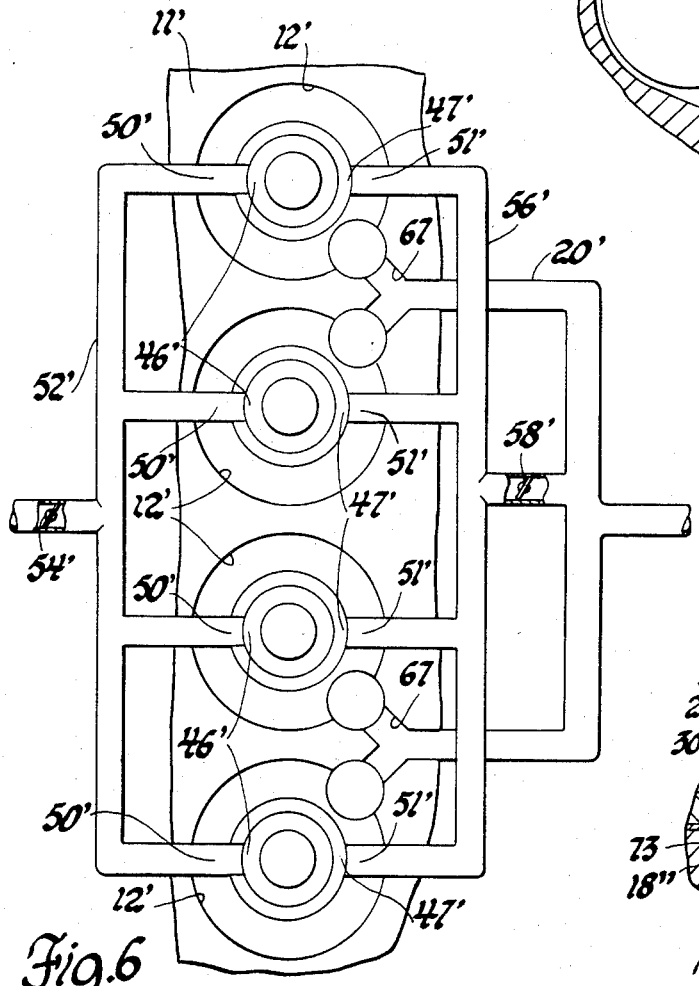
FIG. 6 is a diagrammatic view illustrating an arrangement of cylinders and manifolding for a four stroke cycle engine of the type shown in FIGS. 4 and 5.

FIG. 6 diagrammatically illustrates an arrangement of cylinders and manifolding for a four cylinder four stroke cycle engine having a cylinder construction of the type shown in FIGS. 4 and 5. In FIG. 6, the first intake conduit 52′ is shown as a manifold having the valve 54′ at its entrance and connecting with each of the cylinders 12′ via the inner annular portions 46′ of their intake ports. The second intake conduit 56′ is also shown in the form of a manifold having valve 58′ at its inlet and connecting with each of the cylinders through the outer annular portions 47′ of their intake ports.

The exhaust ports 67 are siamesed to connect with the exhaust conduit 20′ having the form of an exhaust manifold which provides exhaust gas either to the inlet of the conduit manifold 56′ or directs it out of the system. While the manifold arrangement illustrated does not include means for admitting fresh air into the second intake conduit 56′, such means could, of course, be provided. Other manifold arrangement could also be utilized and similar arrangement could be provided for use with two stroke cycle engines.

Figure 7:
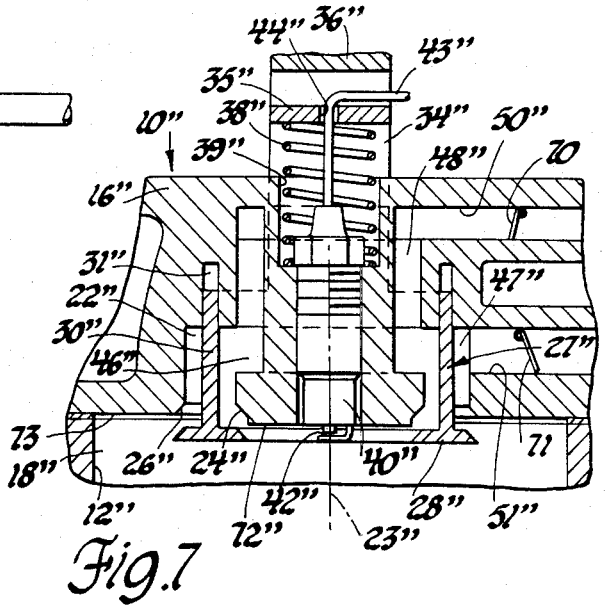
FIG. 7 is a cross-sectional view similar to FIG. 4 but showing an alternative embodiment of four stroke cycle engine wherein the annular valve is utilized as a dual function intake and exhaust valve.

Referring now to FIG. 7, there is shown a somewhat different four stroke cycle engine arrangement wherein the annular valve controls both intake and exhaust flow. For convenience, double primed numbers of similar numerical value are used to identify parts similar to those of the embodiments previously described.

In FIG. 7, the upper cylinder arrangement is generally similar to that of FIG. 1. However, passage 50″, connecting with the inner annular portion 46″, constitutes an intake passage while passage 51″, connecting with the outer annular portion 47″, constitutes an exhaust passage. Check valves 70, 71 are provided in the passages 50″, 51″ respectively to prevent flow opposite from the intended directions. Also the central portion 72 of the cylinder end wall is extended downwardly beyond the main portion 73 of the lower wall face to shroud the initial opening portion inlet port side of the valve.

In operation on the four stroke cycle, the dual function annular valve 27″ begins to open near the end of the power stroke, permitting blowdown of pressurized exhaust gases in the combustion chamber to occur through the outer annular portion 47″ of the port and passage 51″ as permitted by opening of check valve 71. During the initial opening movement of the valve 27″, the extended central portion 72 shrouds the inlet opening to the inner annular portion 46″ to limit the back flow of exhaust gases into the induction conduit.

As exhaust pressure is reduced, the valve is opened fully and the exhaust process is completed on the piston upstroke. The annular valve 27″ remains open on the subsequent piston downstroke during which a fresh charge is drawn into the cylinder through passage 50″ past the check valve 70 and through the inner annular portion 46″ of the port.

During the piston intake stroke, check valve 71 closes limiting the reentry of exhaust gas into the combustion chamber. When operating at reduced throttle, lower pressures in the cylinder will cause a slightly greater portion of exhaust gas to be reingested into the cylinder, providing a warm blanket around the combustible cloud in the central portion of the chamber in a manner similar to that of the applications previously described. At the end of the intake stroke, the annular valve 27″ closes and the compression and power strokes follow in conventional fashion.

While the previously described embodiments have exemplified certain features and embodiments of the present invention, it should be understood that numerous changes could be made without departing from the spirit and scope of the invention concepts disclosed. Accordingly, it is intended that the invention not be limited except by the wording of the following claims.

The embodiments of the invention in which an exclusive property or privilege is claimed are defined as follows:

1. An internal combustion engine having in combination means defining a closed end cylinder having an axis with a piston reciprocable therein, an annular port in said cylinder closed end having an axis substantially coincident with the cylinder axis and having concentric fixed annular valve seats at the inner and outer edges of said port, a valve cooperatively associated with said port and having an annular head surrounding said inner edge valve seat and a tubular stem extending from the head and reciprocably supported in the cylinder closed end, said stem extending through and dividing said port into separate annular inner and outer portions, said head being seatable on said valve seats to close the port inner and outer portions against communication with the cylinder and being movable away from said seats upon reciprocating movement of the stem to permit such communication, whereby actuation of said valve opens and closes communication of said cylinder with said port inner and outer portions in unison, and first and second fluid supply means connected respectively with said port inner and outer annular portions to supply separate fluids thereof, said head extending radially beyond the inner and outer extremes of adjacent portions of said stem and said port to deflect fluids entering the cylinder from the port inner and outer portions into flow patterns having radial components extending respectively inwardly and outwardly from the valve adjacent to the cylinder closed end so as to develop separate oppositely oriented inner and outer toroidal fluid patterns within the engine cylinder.

2. The engine of claim 1 and further comprising an exhaust port in the cylinder near the bottom position of the piston closed end for operation of the engine on the two stroke cycle.

3. The engine of claim 1 and further comprising an exhaust port at one side of the cylinder end and having a separate exhaust valve for operation of the engine on the four stroke cycle.

4. An internal combustion engine having in combination means defining a closed end cylinder with a piston reciprocable therein, an annular port in said cylinder closed end and having concentric fixed annular valve seats at the inner and outer edges of said port, a valve cooperatively associated with said port and having an annular head surrounding said inner edge valve seat and a tubular stem extending from the head and reciprocably supported in the cylinder closed end, said stem extending through and dividing said port into separate annular inner and outer portions, said head being seatable on said valve seats to close the port inner and outer portions against communication with the cylinder and being movable away from said seats upon reciprocating movement of the stem to permit such communication, whereby actuation of said valve opens and closes communication of said cylinder with said port inner and outer portions, and first and second fluid passage means connected respectively with said port inner and outer annular portions, said passage means each being connectable with one of fluid supply and discharge means to supply fluid to or discharge fluid from said cylinder, said head extending radially beyond the inner and outer extremes of adjacent portions of said stem and said port to guide fluids passing between the cylinder and the port inner and outer portions into flow patterns having radial components extending respectively inwardly and outwardly from the valve adjacent to the cylinder closed end.

5. An engine as defined in claim 4 and further comprising spark ignition means including a spark gap disposed radially within the annular valve near the cylinder closed end.

6. The engine of claim 5 wherein the spark gap is disposed substantially on the cylinder axis.

7. An internal combustion engine having in combination means defining a closed end cylinder with a piston reciprocable therein, an annular port in said cylinder closed end and having concentric fixed annular valve seats at the inner and outer edges of said port, a valve cooperatively associated with said port and having an annular head surrounding said inner edge valve seat and a tubular stem extending from the head and reciprocably supported in the cylinder closed end, said stem extending through and dividing said port into separate annular inner and outer portions, said head being seatable on said valve seats to close the port inner and outer portions against communication with the cylinder and being movable away from said seats upon reciprocating movement of the stem to permit such communication, whereby actuation of said valve opens and closes communication of said cylinder with said port inner and outer portions, fluid supply means connected with said inner annular portion and fluid discharge means connected with said outer annular portion to supply intake fluids to and discharge exhaust fluids from said cylinder, said head extending radially beyond the inner and outer extremes of adjacent portions of said stem and said port to deflect intake fluids entering the cylinder from the port inner portion into flow patterns having radial components extending inwardly from the valve adjacent to the cylinder closed end and to guide exhaust fluids leaving the cylinder into flow patterns having radial components extending outwardly from the valve adjacent to the cylinder closed end.

8. The engine of claim 7 and further comprising check valves in said fluid supply and discharge means near said inner and outer annular portions to prevent substantial reverse flow of fluids in said supply and discharge means whereby effective dual function operation of said annular port valve is accommodated.

9. The engine of claim 8 wherein the portion of the cylinder end wall adjacent the inner edge of the annular port valve head is downwardly extended from corresponding portions of the end wall adjacent the annular port valve head outer edge to shroud the port inner portion during initial valve opening and thereby limit backflow to the inner portion during exhaust blowdown.

* * * * *